US007802971B2

(12) United States Patent
Schneider et al.

(10) Patent No.: US 7,802,971 B2
(45) Date of Patent: Sep. 28, 2010

(54) CONTROLLER FOR A VARIABLE DISPLACEMENT FEED PUMP

(75) Inventors: Willi Schneider, Bodelshausen (DE); Torsten Helle, Tuebingen (DE)

(73) Assignee: Joma-Hydromechanic GmbH (DE)

( * ) Notice: Subject to any disclaimer, the term of this patent is extended or adjusted under 35 U.S.C. 154(b) by 405 days.

(21) Appl. No.: 11/849,293

(22) Filed: Sep. 2, 2007

(65) Prior Publication Data

US 2008/0279699 A1 Nov. 13, 2008

Related U.S. Application Data

(63) Continuation of application No. PCT/EP2007/006265, filed on Jul. 13, 2007.

(30) Foreign Application Priority Data

Aug. 21, 2006 (DE) ..... 10 2006 039 698
Dec. 7, 2006 (DE) ..... 20 2006 015 508 U

(51) Int. Cl.
*F04B 1/26* (2006.01)
*F04B 49/12* (2006.01)
*F16D 31/02* (2006.01)

(52) U.S. Cl. ..... 417/220; 417/222.1; 92/13; 60/452; 60/453

(58) Field of Classification Search ..... 417/220, 417/221, 222.1; 92/13; 60/453, 452, 447
See application file for complete search history.

(56) References Cited

U.S. PATENT DOCUMENTS 4,668,171 A * 5/1987 Beutler et al. ..... 417/213
5,993,168 A * 11/1999 Erkkilae et al. ..... 417/213
6,311,489 B1 * 11/2001 Stangl et al. ..... 60/452
2002/0014075 A1 * 2/2002 Sawada et al. ..... 60/468

FOREIGN PATENT DOCUMENTS

JP 9-226610 * 9/1997

* cited by examiner

*Primary Examiner*—Charles G Freay
(74) *Attorney, Agent, or Firm*—Brinks Hofer Gilson & Lione

(57) ABSTRACT

The disclosure relates to a feed pump for hydraulic media having an input and an output. A pressure-reducing element is connected to the output, at the output of the element the system pressure being present and the output being connected to a consumer, wherein the output is connected to the first input of a pump controller, the second input being connected to the output of the pressure-reducing element, and wherein the pump controller adjusts the feed pump toward maximum delivery if the system pressure is smaller than a minimum pressure or if the system pressure is smaller than the feed pressure, and wherein parallel to the pump controller a pressure limiter is switched such that at the first input thereof the feed pressure is present and at the control input the system pressure is present, wherein the pressure limiter opens if the feed pressure is greater than a desired value.

17 Claims, 16 Drawing Sheets

CONTROLLER FOR A VARIABLE DISPLACEMENT FEED PUMP

CROSS-REFERENCE TO RELATED APPLICATIONS

This application is a continuation of International Application No. PCT/EP2007/006265 filed on Jul. 13, 2007, which claims the benefit of German Patent Application No. 10 2006 039 698.7-15, filed Aug. 21, 2006 and German Patent Application No. 20 2006 015 508.2, filed Dec. 7, 2006. The disclosures of the above applications are incorporated herein by reference.

FIELD

The present disclosure relates to feed pumps for hydraulic media.

BACKGROUND

The statements in this section merely provide background information related to the present disclosure and may not constitute prior art.

Feed pumps have a displacement volume, which depends on the rotational speed of the feed pump and the drive thereof. Depending on the system resistance of the power-consuming device or the devices consuming the delivered hydraulic medium, the system pressure also depends on the displacement volume. In general, there is a desire to maintain the system pressure at a constant level or at least within a defined range.

From DE 101 04 635 A1 a method is known for maintaining a constant output value of a feed pump. With this method, the rotational speed of the pump drive is controlled as a function of the output pressure of the feed pump. This requires a controllable transmission, which under certain circumstances can be very complex and costly, depending on the power output of the feed pump.

SUMMARY

The present disclosure provides a feed pump, particularly a pump controller, which is easier to adjust to a desired system pressure, which is achieved with a feed pump having the characteristics of the claims as set forth below.

Advantageous embodiments, advantages, characteristics and details of the present invention will be apparent from the dependent claims as well as the description provided hereinafter, which describes the invention with reference to particularly preferred embodiments that are illustrated in the figures. The characteristics illustrated in the figures and mentioned in the claims as well as in the description can be essential for the invention either alone or in any random combination.

DRAWINGS

The drawings described herein are for illustration purposes only and are not intended to limit the scope of the present disclosure in any way.

FIG. 1 is a block diagram of a first embodiment of the present disclosure;

FIG. 1*a* is an enlarged illustration of the pressure limiter according to FIG. 1;

Figure 1:
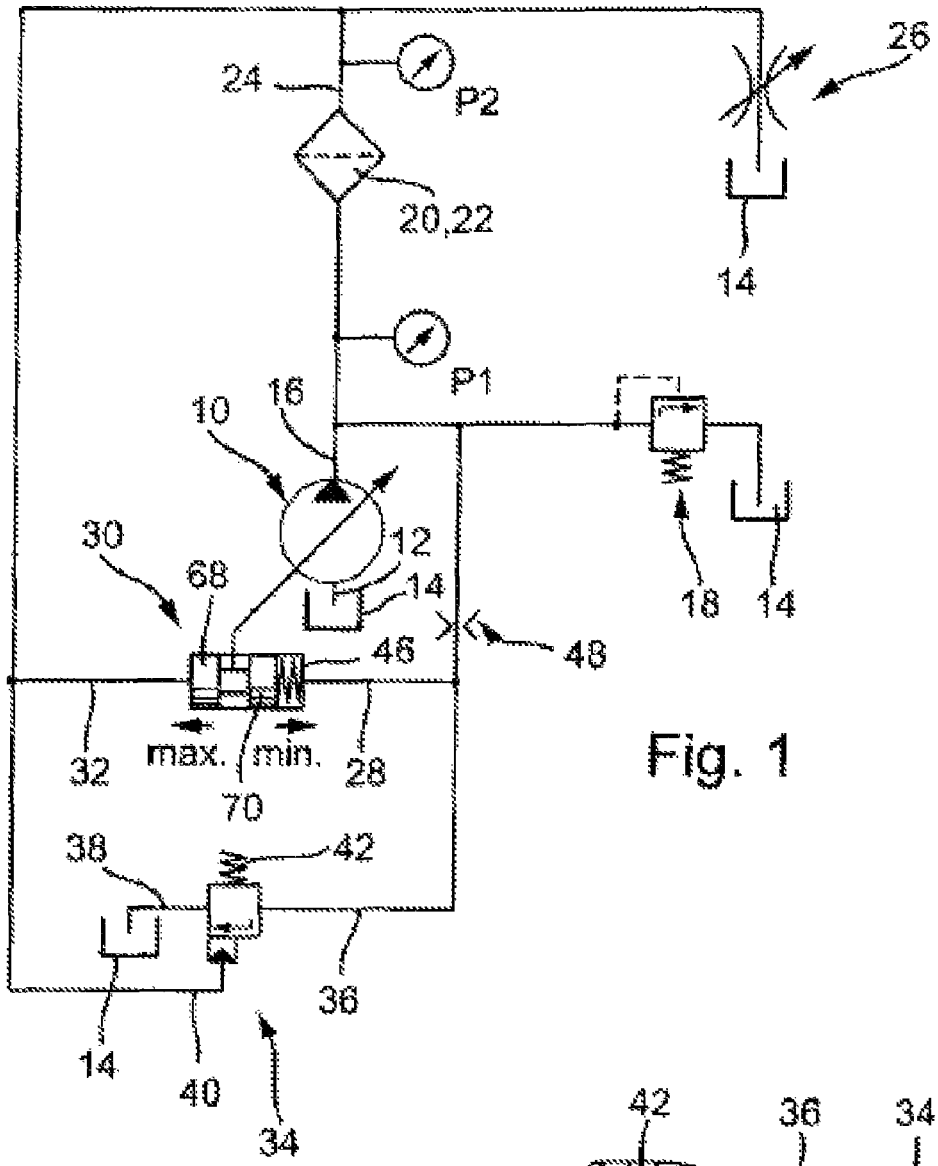
Figure 3:
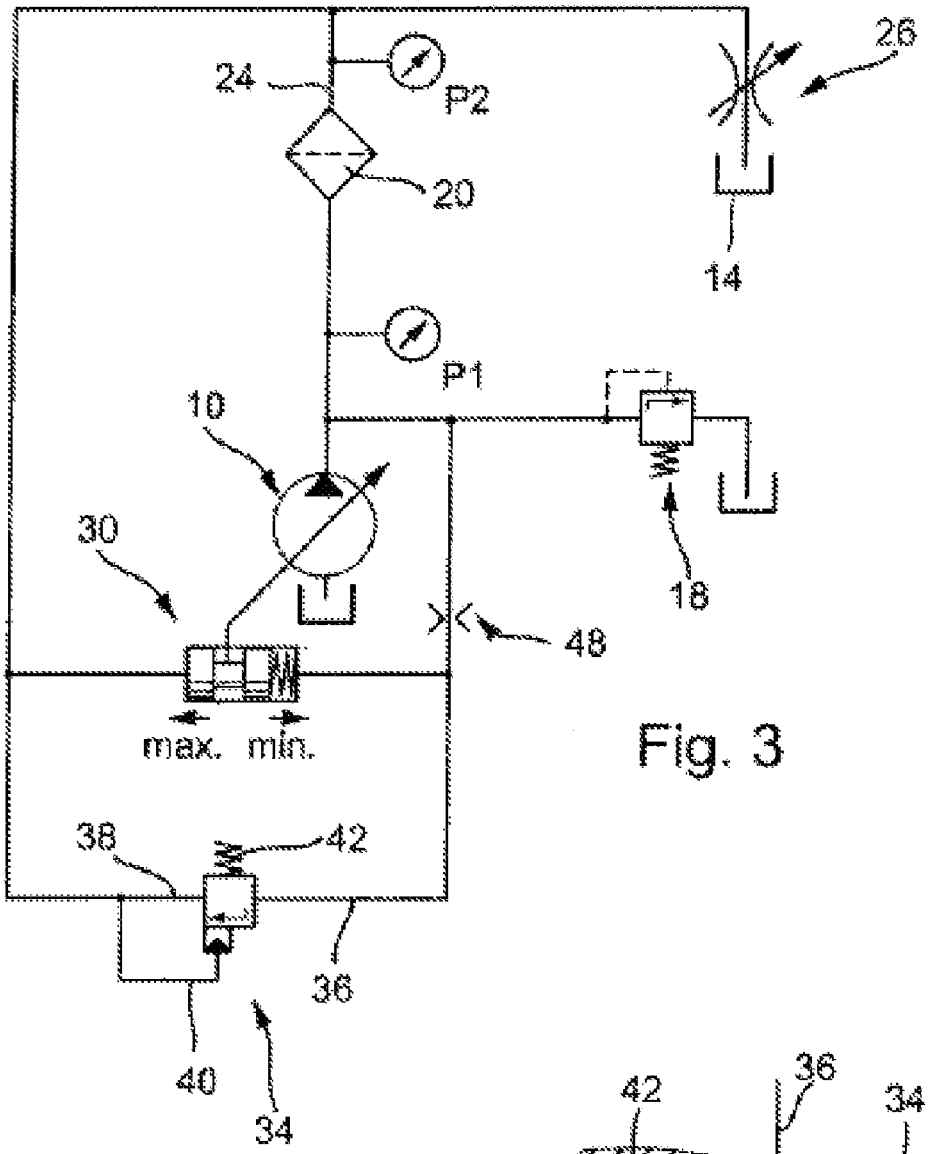
FIG. 3 is a variant of the embodiment according to FIG. 1 with substantially loss-free delivery.
Figure 3A:
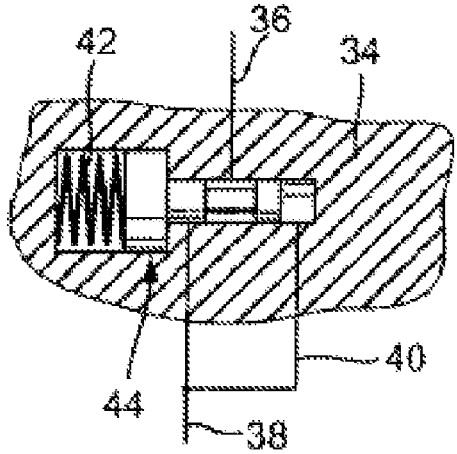
Figure 4:
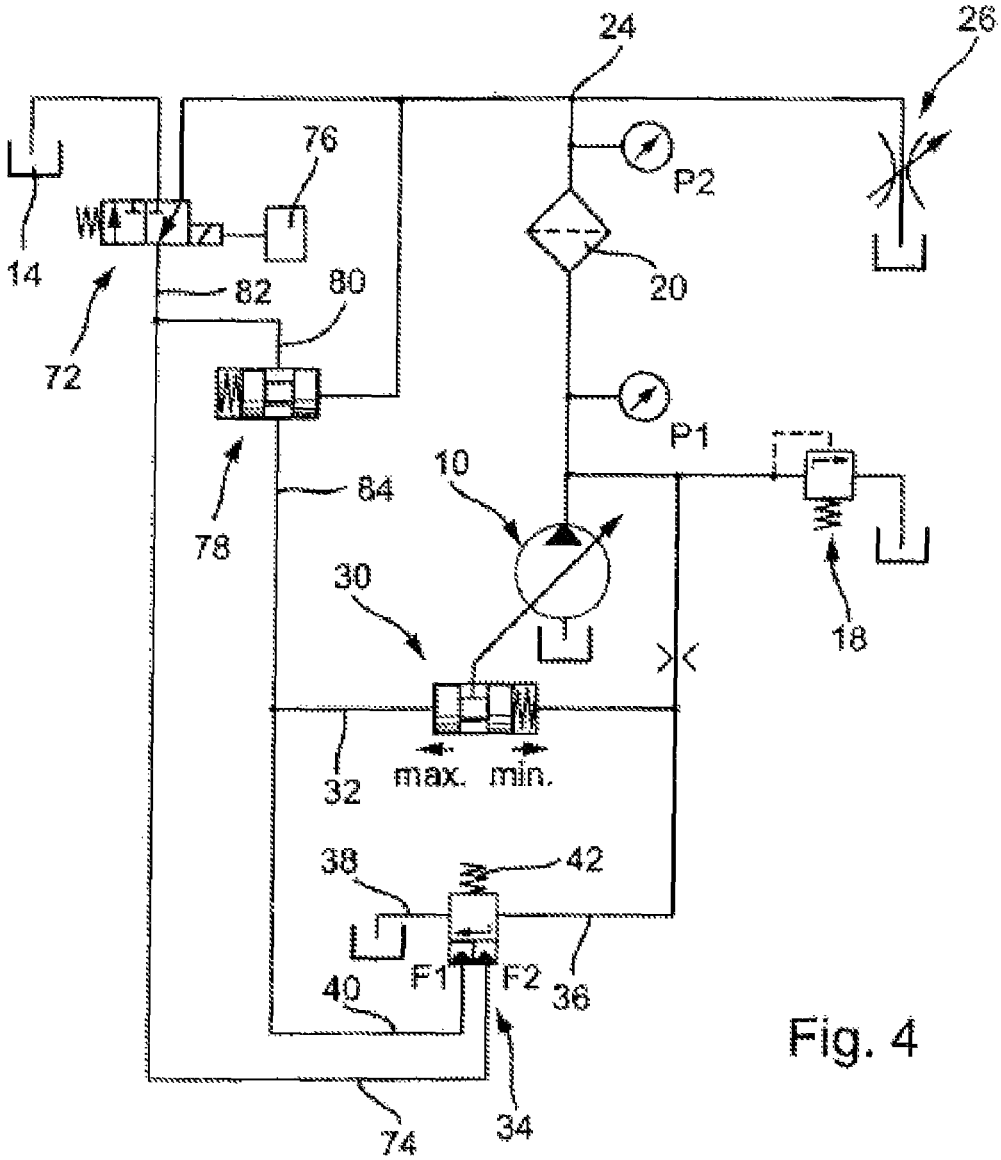
Figure 4A:
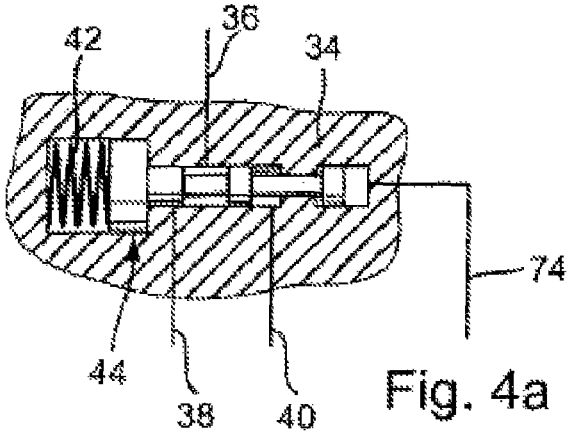
Figure 5:
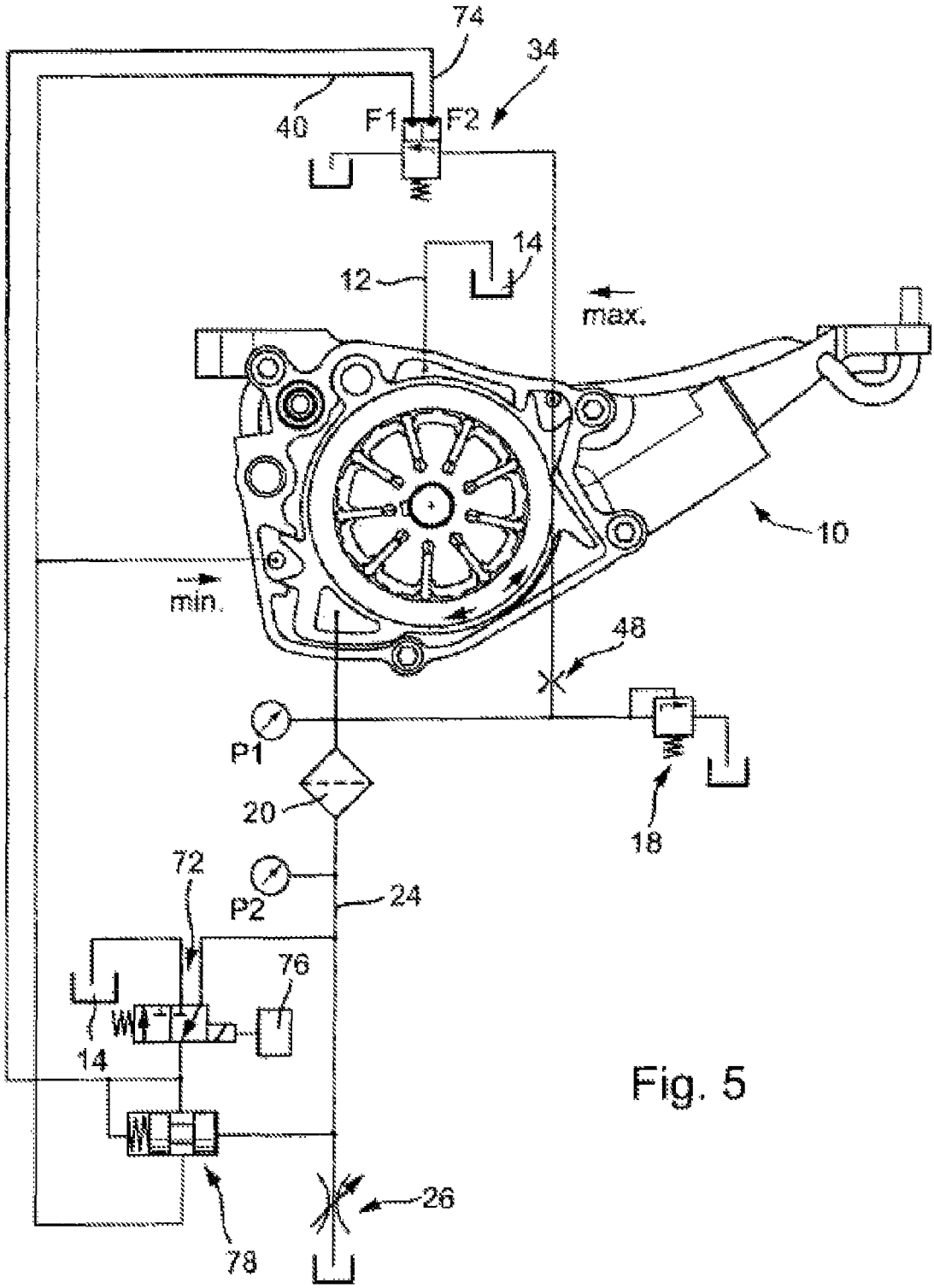
Figure 6:
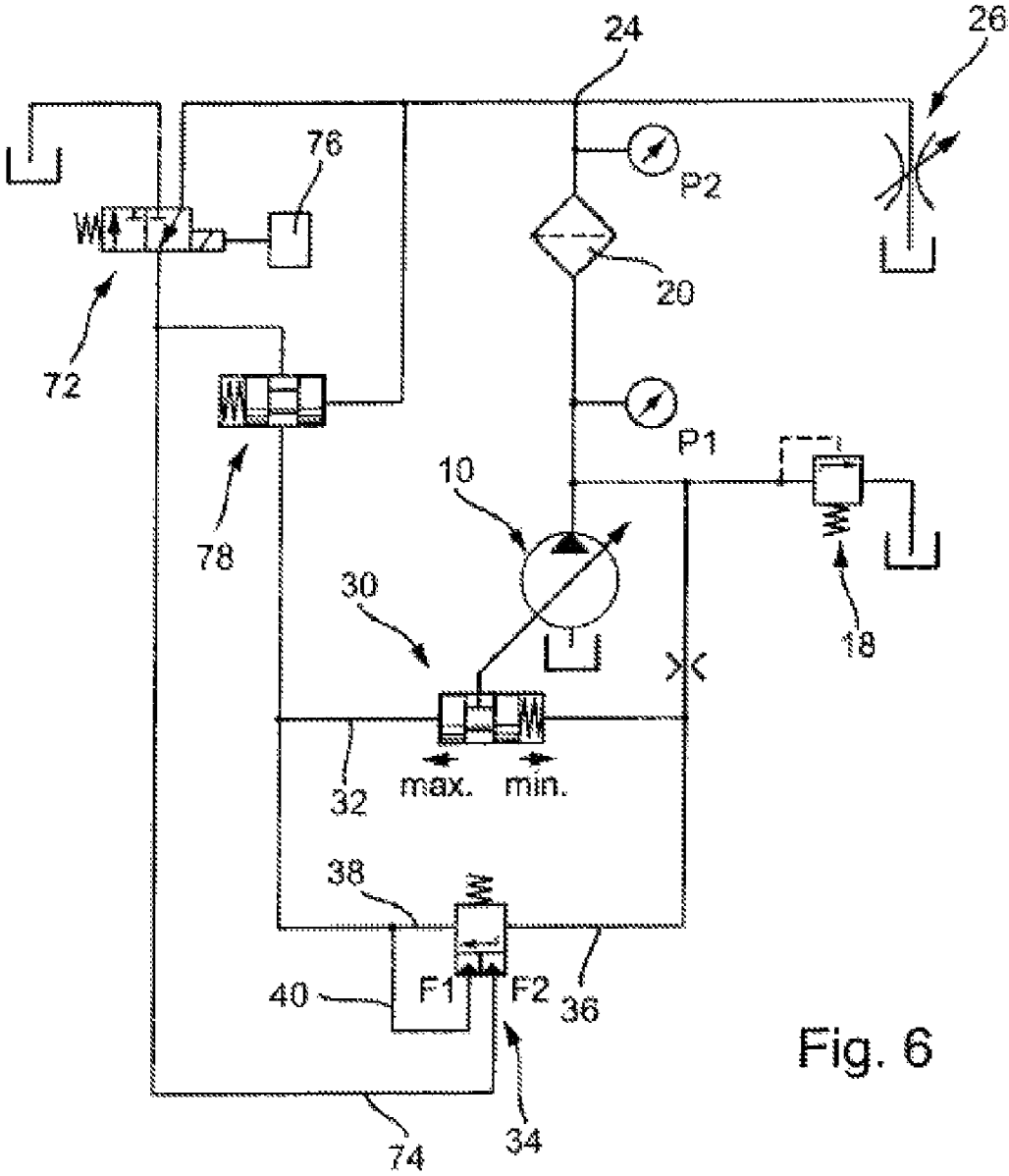
Figure 6A:
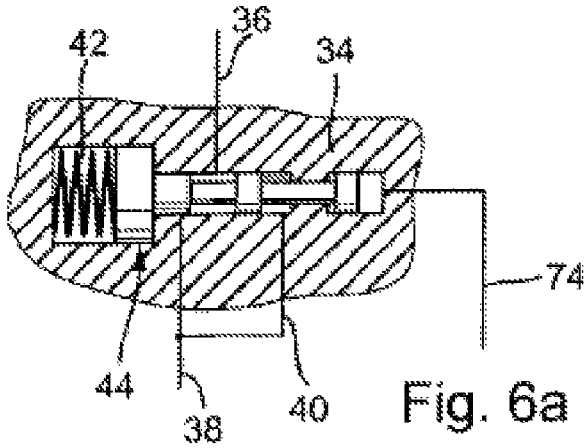
Figure 7:
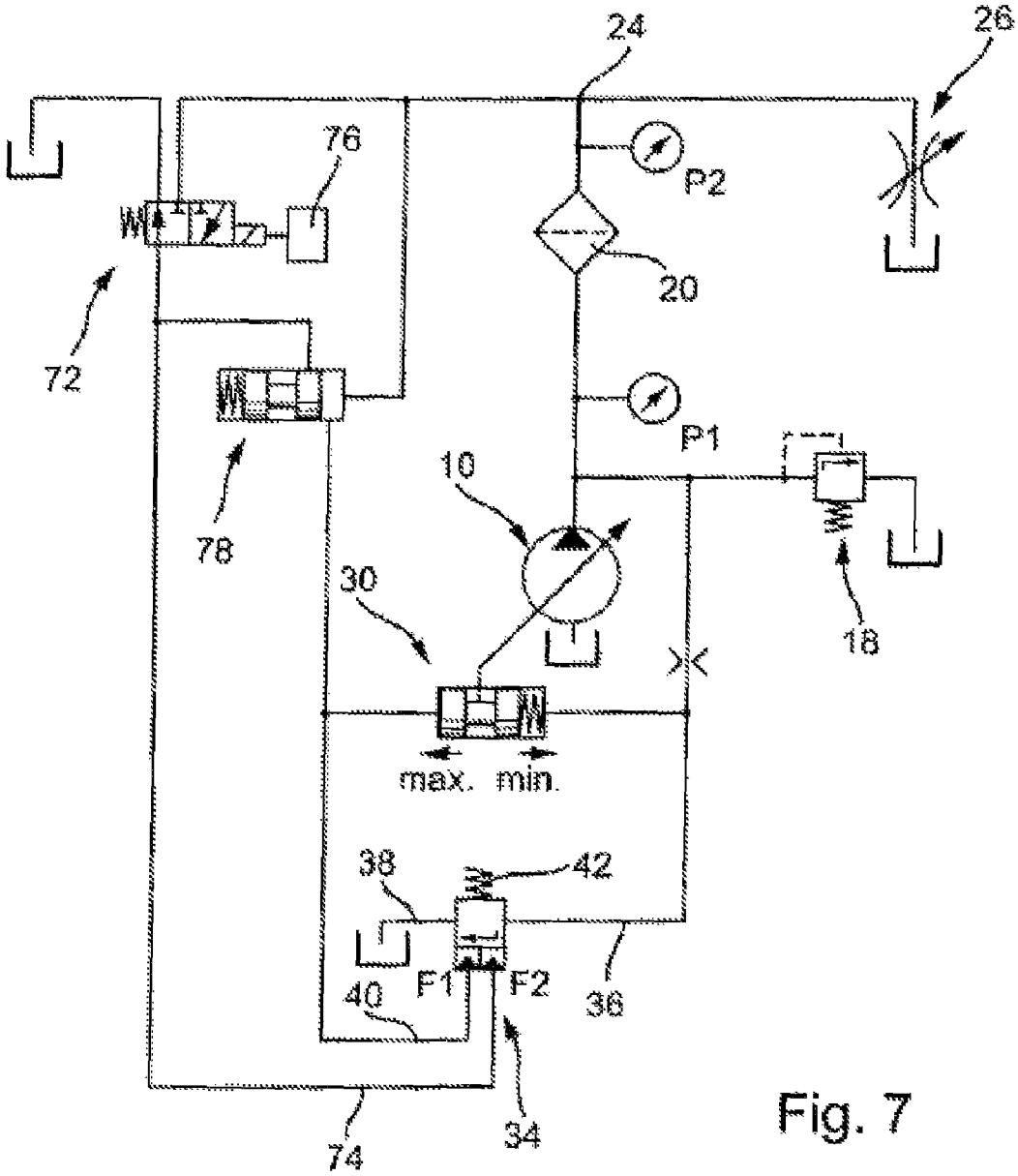
Figure 8:
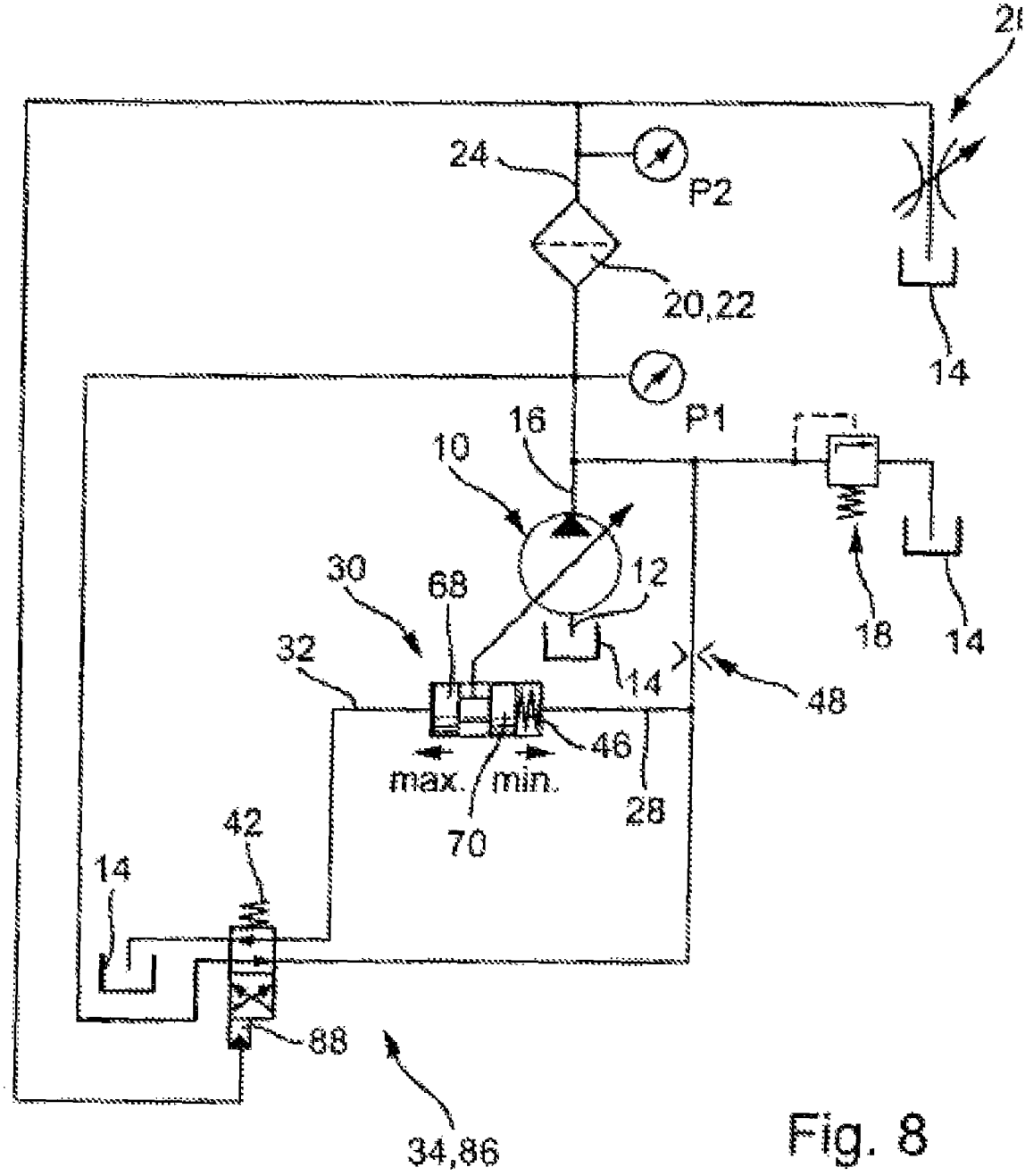
Figure 9:
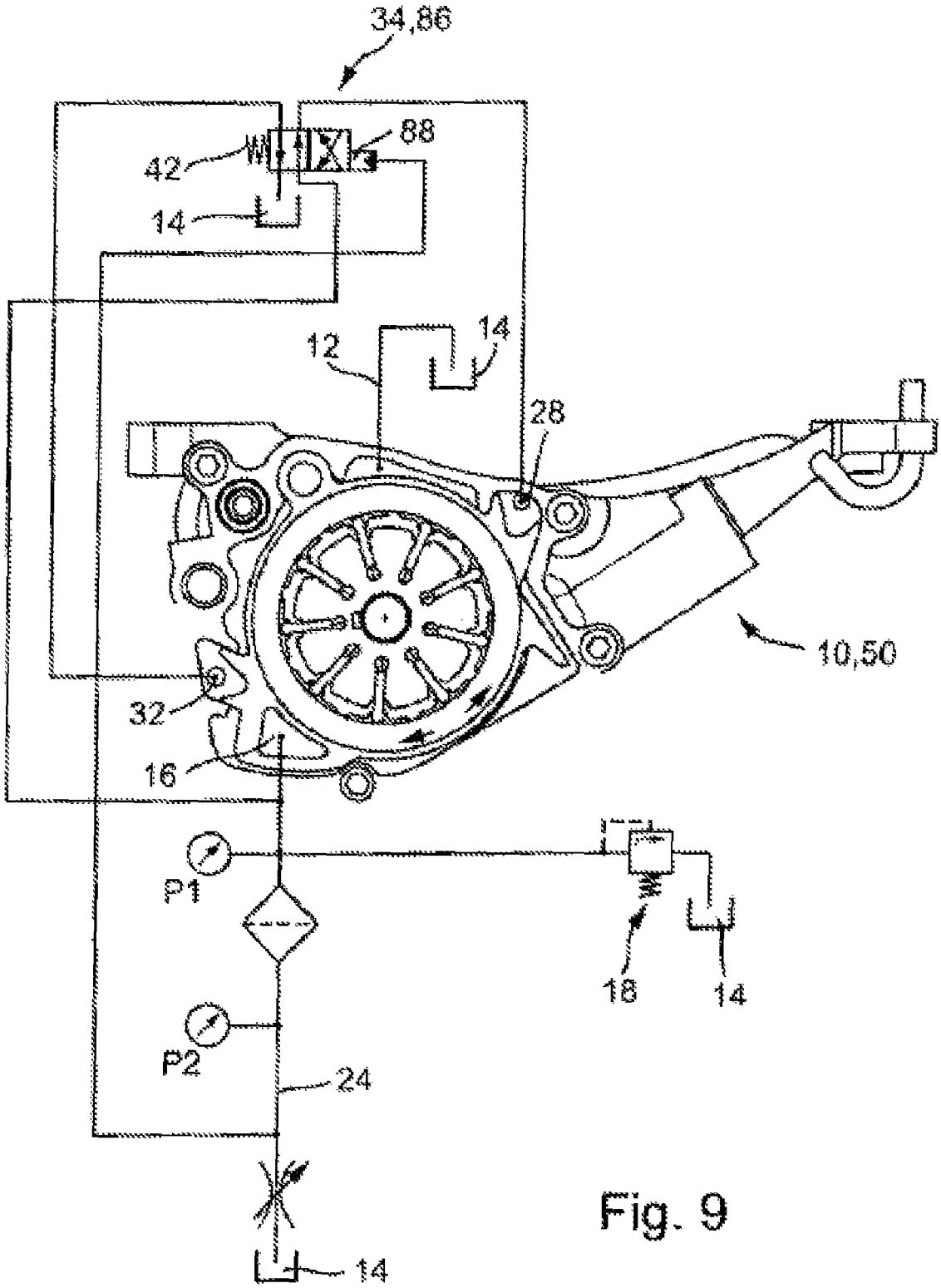
Figure 10:
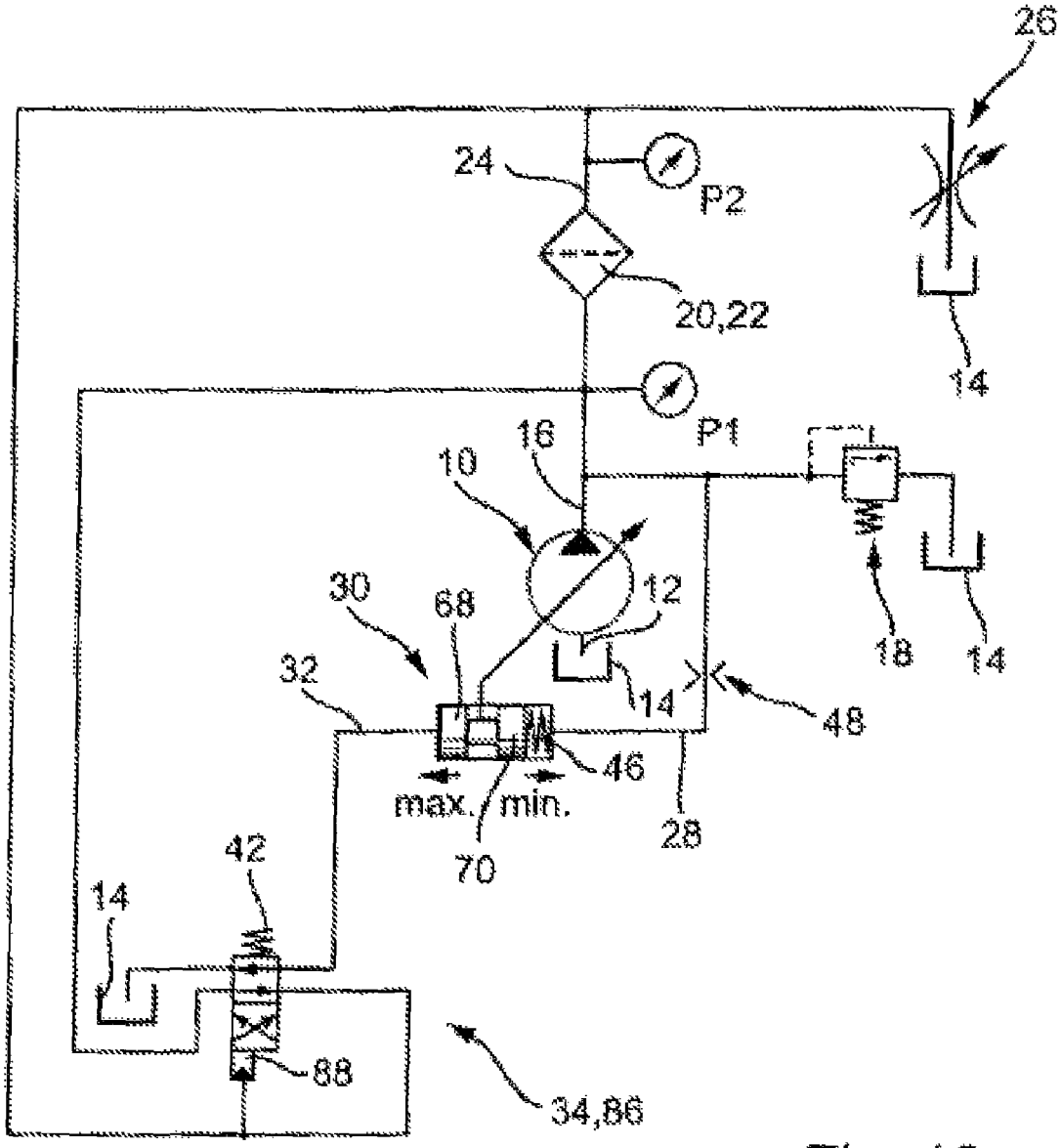
Figure 11:
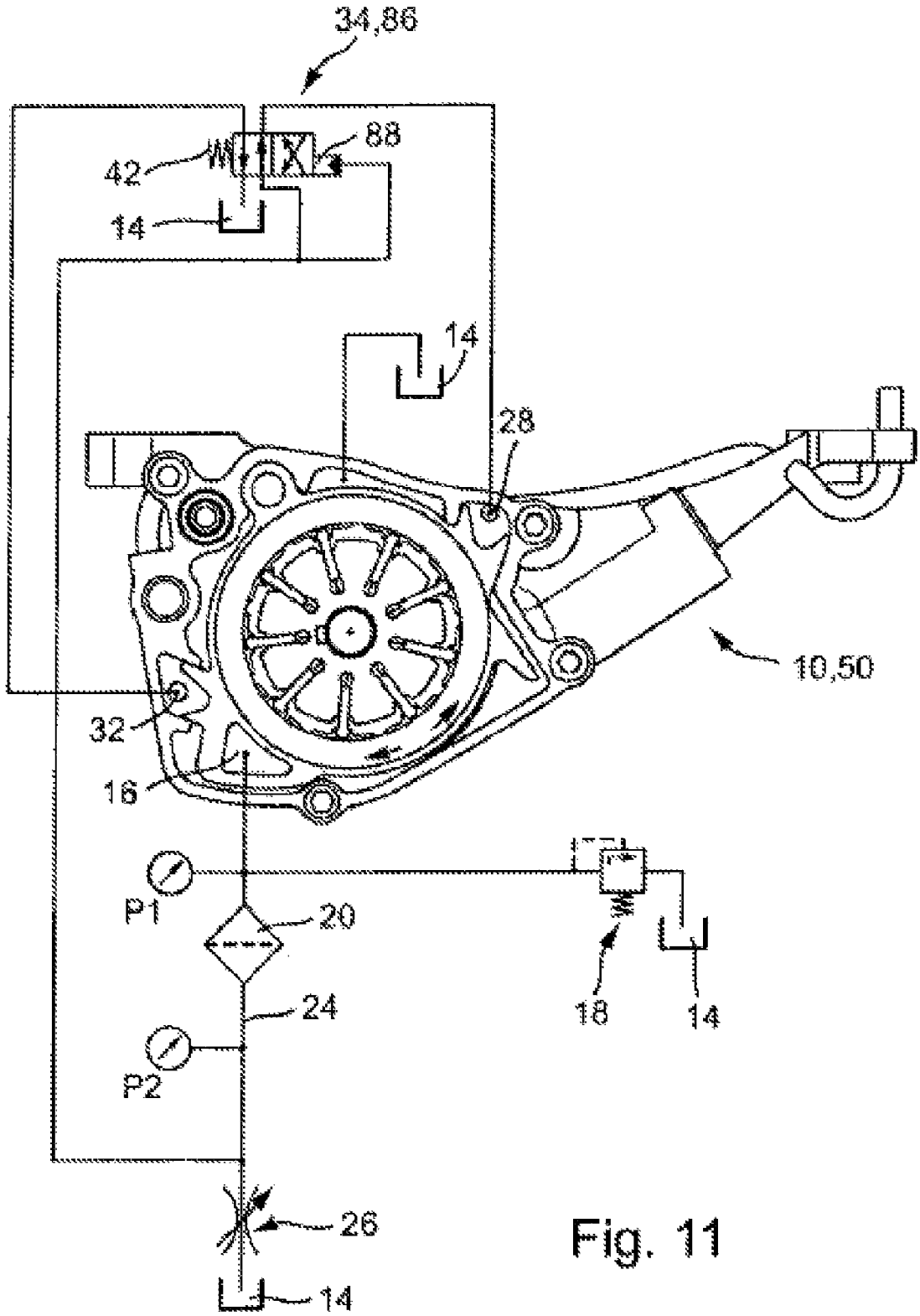
Figure 12:
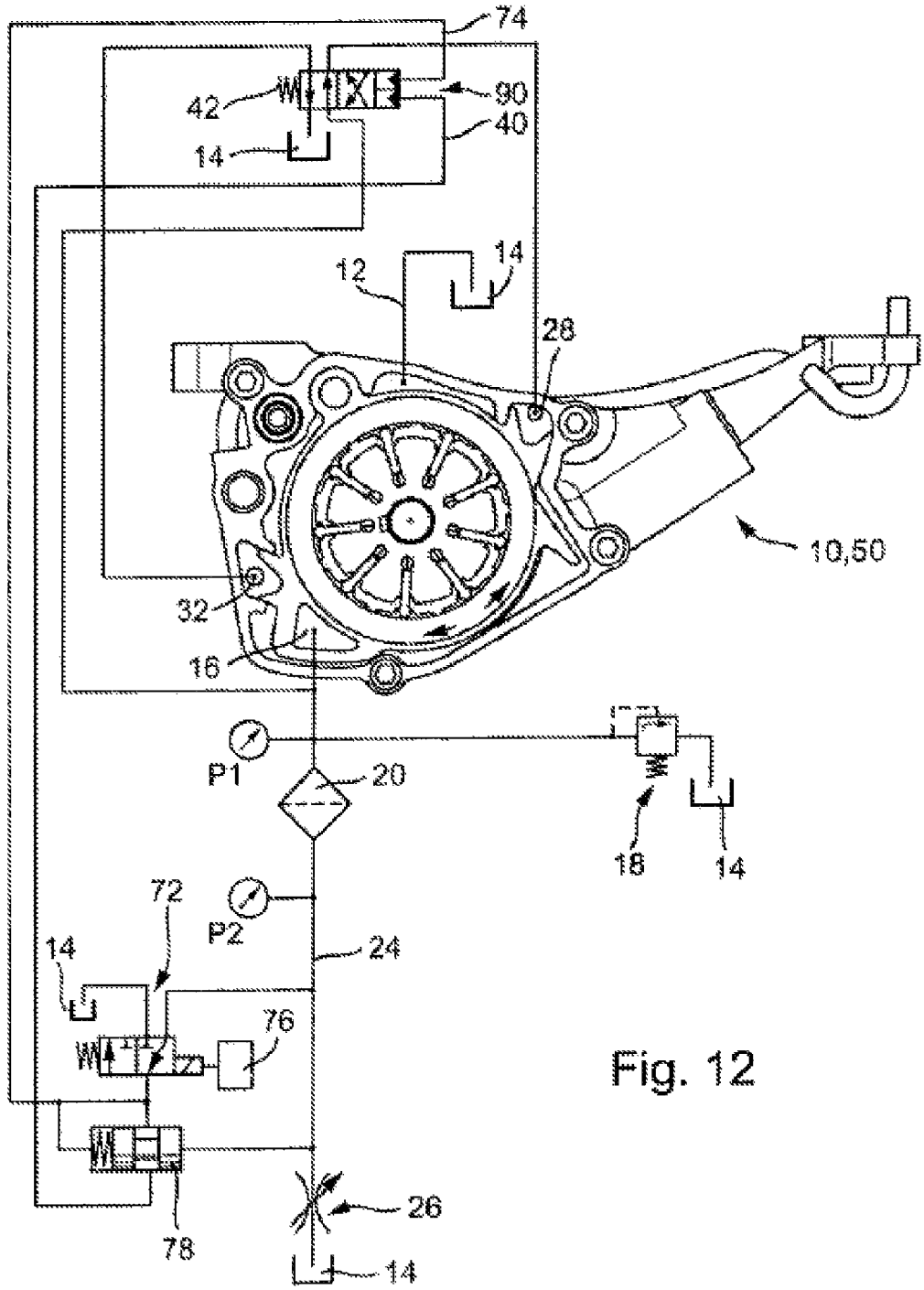
Figure 13:
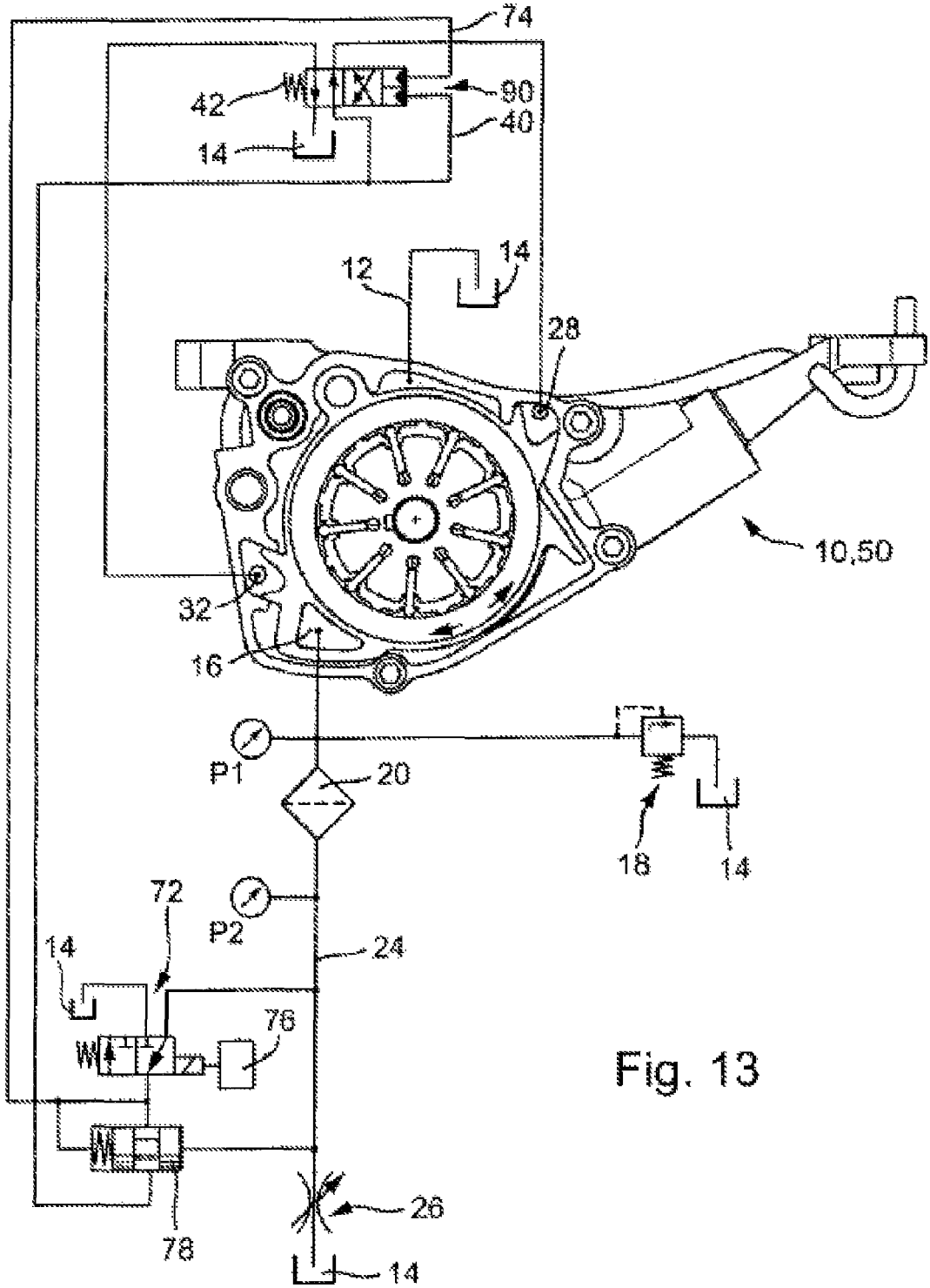
Figure 14:
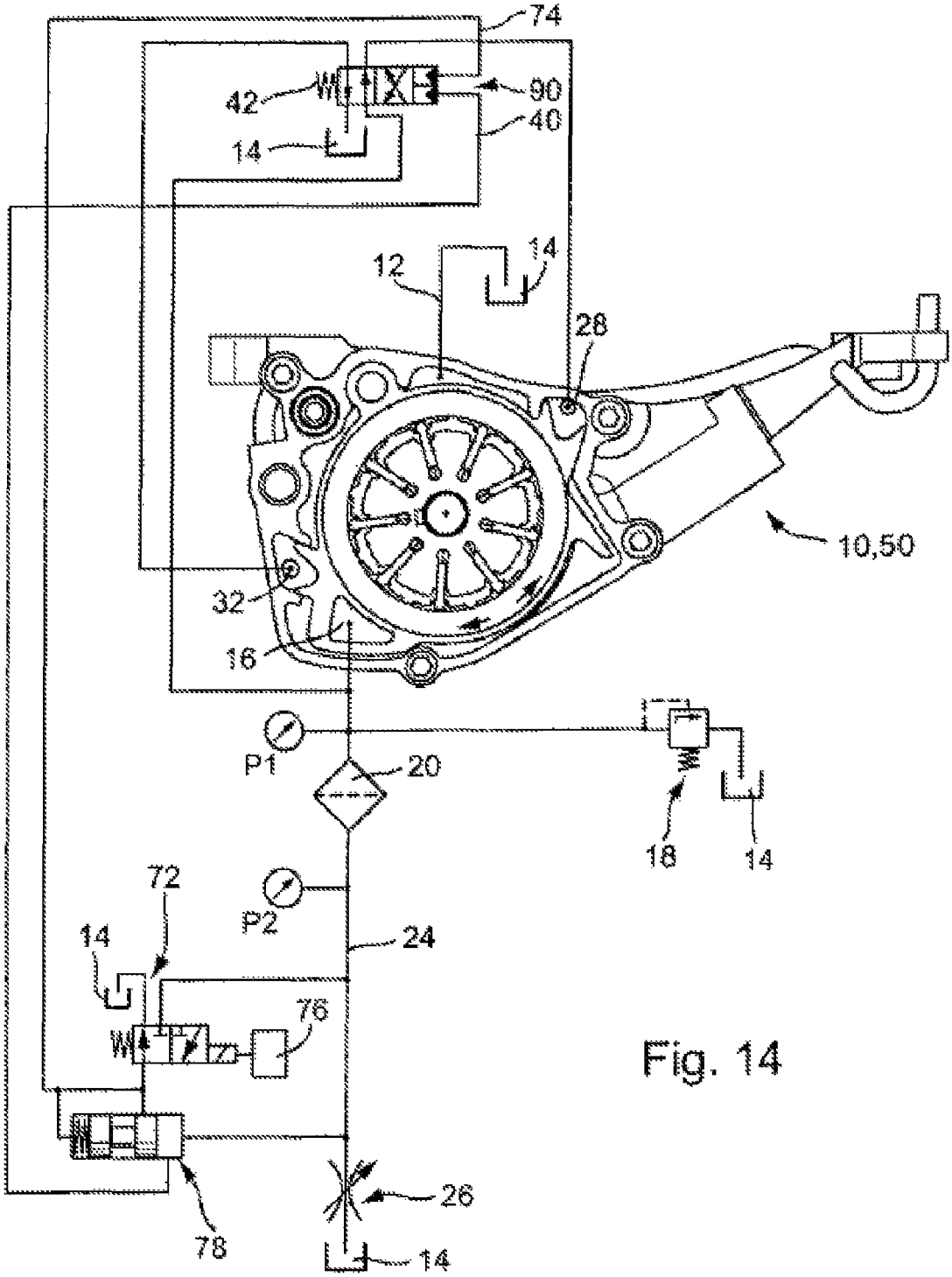
Figure 15:
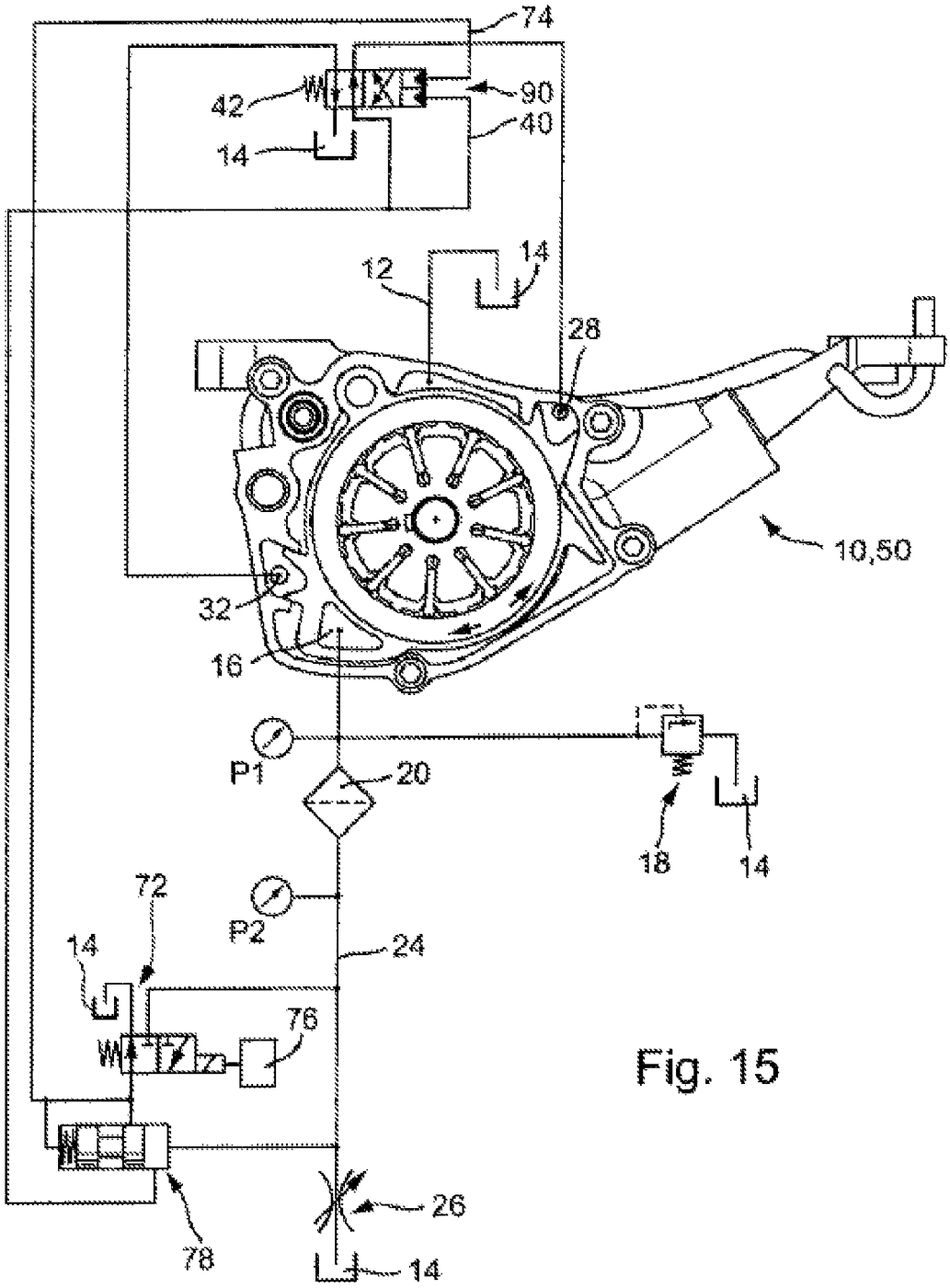
Figure 16:
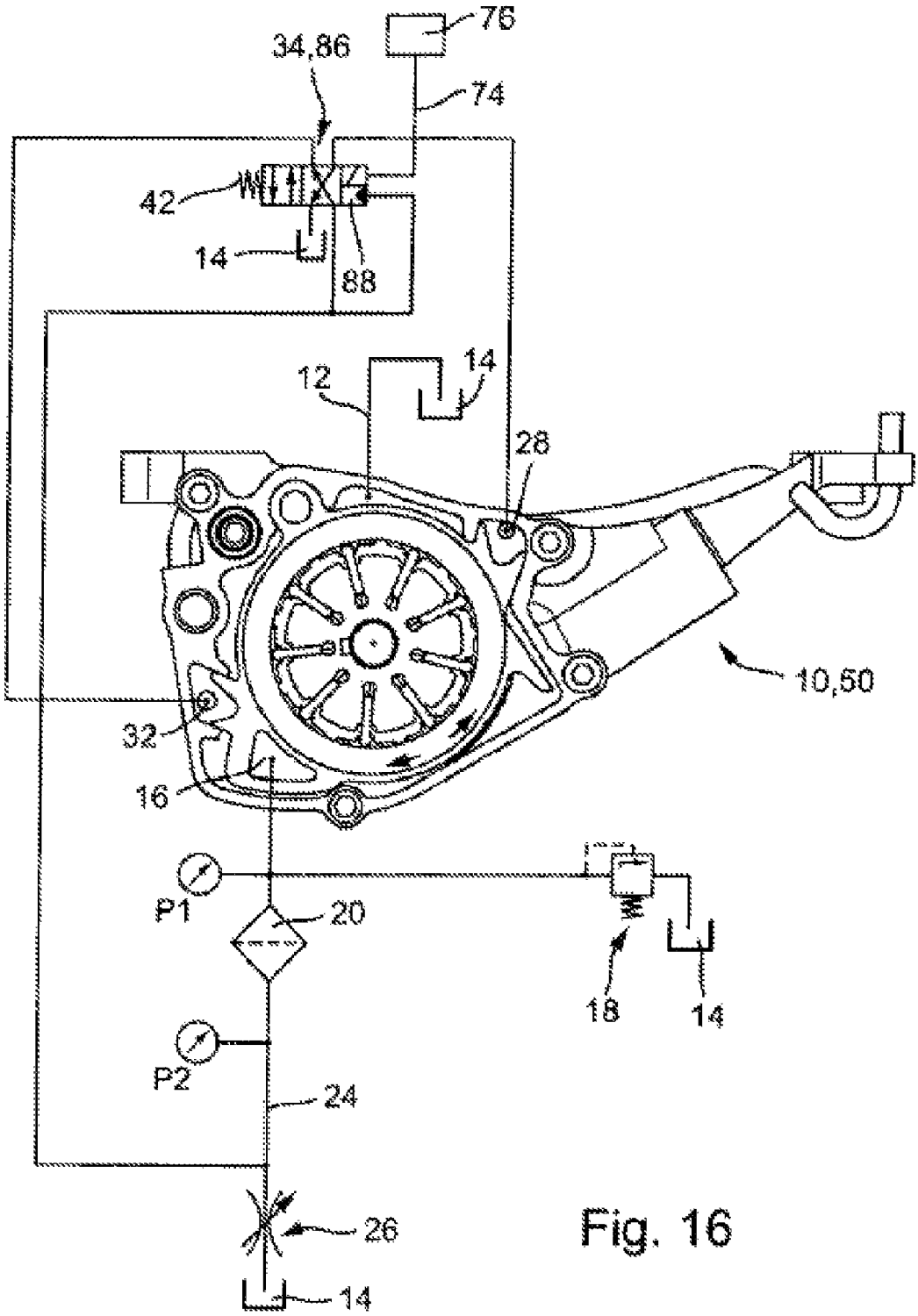

FIG. 3*a* is an enlarged illustration of the pressure limiter according to FIG. 3;

FIG. 4 is a variant of the embodiment according to FIG. 1 with a system pressure that is controlled within a range;

FIG. 4*a* is an enlarged illustration of the pressure limiter according to FIG. 4;

FIG. 5 is an application example of the circuit according to FIG. 4 in a vane-type pump with adjustable rotor;

FIG. 6 is a variant of the embodiment according to FIG. 4 with a system pressure that is controlled within a range with substantially loss-free delivery;

FIG. 6*a* is an enlarged illustration of the pressure limiter according to FIG. 6;

FIG. 7 is the variant according to FIG. 4 with failure of the map controller;

FIG. 8 is a block diagram of a further embodiment of the disclosure with constant pressure control;

FIG. 9 is an application example of the circuit according to FIG. 8 in a vane-type pump with adjustable rotor;

FIG. 10 is a block diagram of a further embodiment of the disclosure with constant pressure control;

FIG. 11 is an application example of the circuit according to FIG. 10 in a vane-type pump with adjustable rotor;

FIG. 12 is an application example of a further embodiment of the disclosure with map control in a vane-type pump with adjustable rotor;

FIG. 13 is an application example of a further embodiment of the disclosure with map control in a vane-type pump with adjustable rotor;

FIG. 14 is a variant of the application example according to FIG. 12 with failure of the map control function;

FIG. 15 is a variant of the application example according to FIG. 13 with failure of the map control function; and FIG. 16 is a variant of the disclosure according to FIG. 8.

DETAILED DESCRIPTION

The following description is merely exemplary in nature and is not intended to limit the present disclosure, application, or uses.

The block diagram shown in FIG. 1 shows a feed pump marked with reference numeral 10, the pump's volume being variable. The feed pump 10 comprises an input 12, which is connected to a tank 14. At the output 16, the feed pressure P1 is present and at the output 16 a pressure control valve 18 is connected. This pressure control valve 18 is likewise connected to the tank 14. If the feed pressure P1 exceeds the opening pressure of the pressure control valve 18, for example 12 bar, hydraulic medium flows into the tank 14. In addition, the output 16 is connected to a pressure-reducing element 20, for example to a filter 22, a diaphragm or the like. At the output 24 of the pressure-reducing element 20, the system pressure P2 is present. The hydraulic medium delivered by the feed pump 10 reaches a consumer 26, which is an internal combustion engine of a motor vehicle, for example. Downstream of the consumer 26, the hydraulic medium flows into the tank 14. As a result of the pressure-reducing element 20, the system pressure P2 is smaller than the feed pressure P1.

The output 16 of the feed pump 10 is additionally connected to a first input 28 of a pump controller 30, the second input 32 thereof being connected to the output 24 of the pressure-reducing element 20. Reference numeral 46 denotes the minimum pressure of the pump controller 30. The pump controller 30 adjusts the feed pump 10 toward minimum delivery if the pressure at the second input 32 is greater than the pressure at the first input 28. The pressure P2 present at the second input 32, however, must exceed at least a minimum pressure of 2 bar, for example. If the pressure present at the first input 28 or the minimum pressure of 2 bar, for example, exceeds the system pressure P2, the pump controller 30 adjusts the feed pump 10 toward maximum delivery. As long as the system pressure P2 is below the minimum pressure, the feed pump 10 is adjusted toward maximum delivery.

A pressure limiter 34 is connected in parallel to the pump controller 30, the first input 36 of the limiter being connected to the first input 28 of the pump controller 30 and the second input 38 of the limiter being connected to the tank 14. At the control input 40, the system pressure P2 is present. In particular, the desired value 42 of the pressure limiter 34 is variable and is 5.5 bar, for example. This means that the pressure limiter 34 connects the first input 36 to the second input 38 if the pressure at the control input 40 exceeds the desired value 42, which is to say if the system pressure P2 exceeds the desired value. Hydraulic medium flows into the tank 14. As a result, the pressure at the first input 28 of the pump controller 30 is reduced to below the system pressure P2, so that the pump controller 30 adjusts the feed pump 10 toward minimum delivery. The system pressure P2 consequently likewise decreases, until it has dropped below the value of the feed pressure P1, whereupon the pump controller 30 is adjusted again toward maximum delivery. The system pressure P2 is therefore maintained between the minimum pressure and the desired value 42. From the pressure limiter 34 hydraulic medium is drained into the tank 14, wherein the medium has not yet passed through the pressure-reducing element 20. The system pressure P2 is only varied by an adjustment of the feed pump 10. In addition, the figure reveals that between the output 16 of the feed pump 10 and the first input 38 of the pump controller 30 a regulator 48 is provided, which in particular is variable.

Figure 1A:
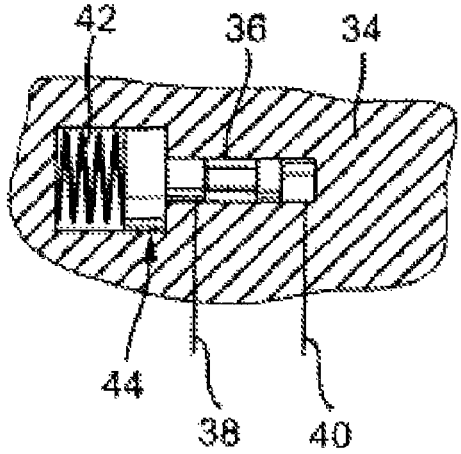

In FIG. 1*a*, the control spool 44 of the pressure limiter 34 is shown, wherein the control spool 44 is illustrated in a position in which it disconnects the first input 36 from the second input 38.

Figure 2:
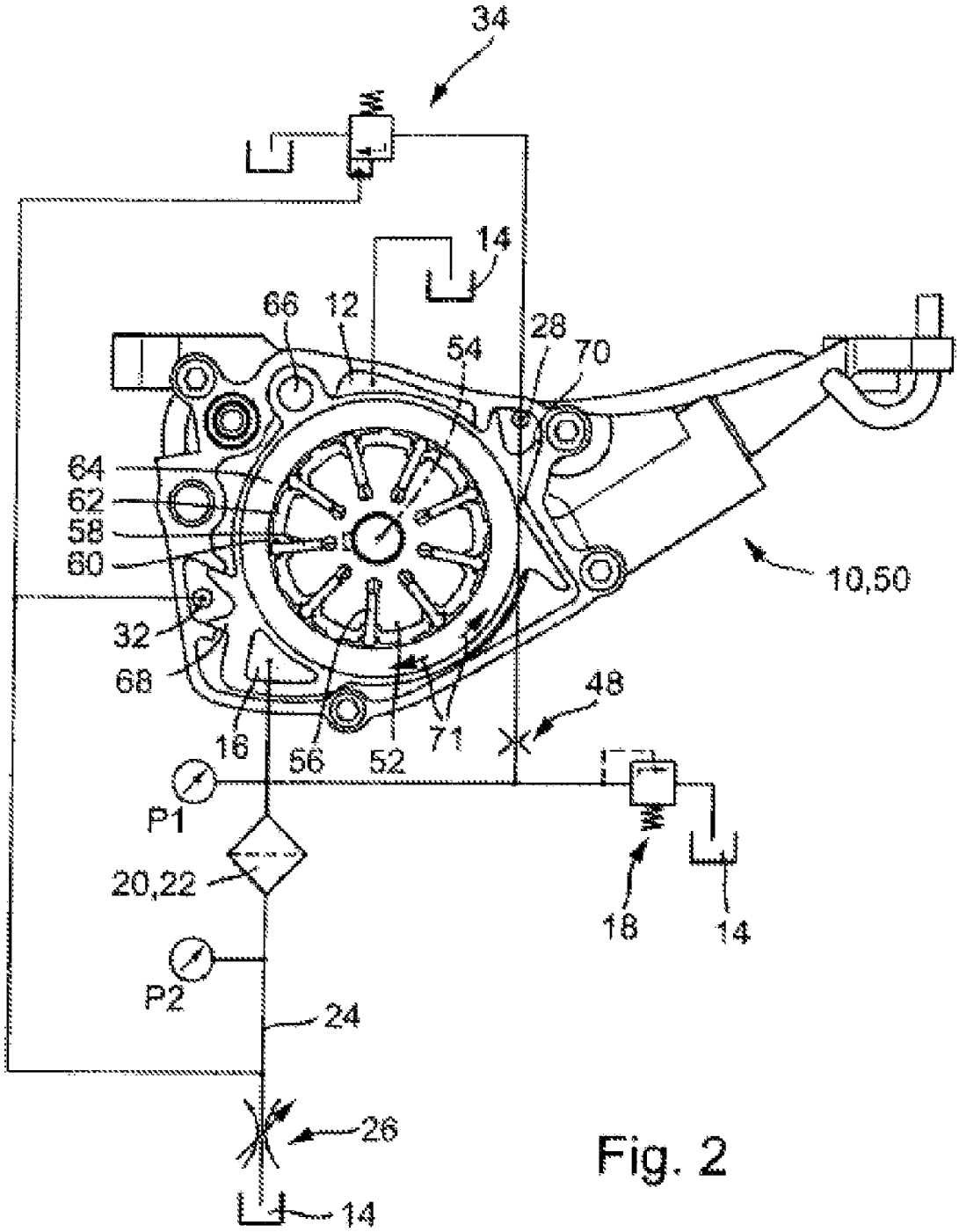
FIG. 2 is an application example of the circuit according to FIG. 1 in a vane-type pump with adjustable rotor.

FIG. 2 shows one embodiment of a feed pump 10, to which the above-mentioned components are connected. Identical components are identified by the same reference numerals. The figure shows that the feed pump 10 is a vane-type pump 50, the rotor 52 of which is driven by a shaft 54 and carries a plurality of vanes 58 in radial slots 56, the vanes revolving on an inner circumferential surface 62 of a stator 64 via slippers 60. The stator 64 is mounted pivotably and comprises a swivel axis 66 as well as two pistons 68 and 70, which correspond to the pistons 68 and 70 of the pump controller 30 in FIG. 1. By swiveling the stator 64 about the swivel axis 66 in the direction of the arrows 71, the delivery output power of the feed pump 10 is varied.

In the variant shown in FIG. 3, the second input 38 of the pressure limiter 34 is connected to the control input 40 so that the pressure present at the first input 36 is transmitted to the second input 38 when the pressure limiter 34 is open. Such a circuit has the crucial advantage that is operates substantially loss-free. FIG. 3*a* shows that the second input 38 is directly connected to the control input 40 and that a displacement of the spool 44 brings about a connection of the two inputs 36 and 38.

FIG. 4 shows the output 24 of the pressure-reducing element 20 with an electromagnetically driven control valve 72 (a 3/2-way valve). In the operating position of the control valve 72 shown in FIG. 4, the output 24 of the pressure-reducing element 20 is connected to a second control input 74 of the pressure limiter 34 via the control valve 72. The actuating forces for the pressure limiter 34 are the system pressure P2 present at the first control input 40 with the force F1 acting inside the control spool 44 as well as the system pressure P2 present at the second control input 74 with the force F2 acting inside the control spool 44.

The control spool 44 is shown in FIG. 4*a*, which clearly reveals that as result of the larger effective piston surface the force F2 is greater than the force F1, which only acts on a ring surface.

The control valve 72 is controlled, for example, by a motor computer 76, which enables a map control of the feed pump 10. The system pressure P2 can be adjusted to any value between the minimum pressure (pump controller 30) and the desired value 42 (pressure limiter 34).

FIG. 4 furthermore shows a shut-off valve 78, which is controlled by the system pressure P2 and the input 80 of which is connected to the output 82 of the control valve 72. The output 84 of the shut-off valve 78 is connected to the second input 32 of the pump controller 30 as well as to the control input 40 of the pressure limiter 34. At the control input 40, accordingly the system pressure P2 is present.

If the control valve 72 is controlled by the motor computer 76 and assumes the position shown in FIG. 4, at the second control input 74 of the pressure limiter 34 the system pressure P2 is present and the pressure limiter 34 opens because the force F2 as a result of the system pressure P2 at the second control input 74 is added to the force F1 of the system pressure P2 at the control input 40, so that both inputs 36 and 38 are connected to each other. The pump controller 30 adjusts the feed pump 10 toward minimum delivery.

Once the desired system pressure P2 is reached, which is detected by the motor computer 76, the control valve 72 is switched and closes the second control input 74. The system pressure P2 then increases until it has reached the desired value 42 or until the motor computer 76 again controls and opens the control valve 72. In this way, the system pressure P2 can be adjusted in accordance with a map control within a defined range to desired different values.

FIG. 5 shows the feed pump 10 with the circuit illustrated in FIG. 4. In addition to the embodiment shown in FIG. 2, the pressure limiter 34 comprises a second control input 74, which is connected to the control valve 72 as well as the shut-off valve 78. The control valve 72 is controlled by the motor computer 76 and connects the second control input 74 via the shut-off valve 78 to the output 24 of the pressure-reducing element 20.

In the variant shown in FIG. 6, as in FIG. 3, the control input 40 of the pressure limiter 34 is connected to the second input 38 thereof. This is also clearly apparent from FIG. 6*a*, which shows the control spool 44 in the pressure limiter 34. This variant represents substantially loss-free control of the feed pump 10.

FIG. 7 shows the position of the circuit upon failure of the motor computer 76 or the map control. In this case, the control valve 72 is not controlled and closes the output 24 in the direction of the shut-off valve 78 and the pressure limiter 34. Accordingly, no pressure is present at the second control input 74, so that the force F2 is zero. No pressure is present either at the second input 32 of the pump controller 32, so that the controller assumes the position for maximum delivery. Consequently, the system pressure P2 increases until the shut-off valve 78 is switched and the output 34 is connected to the pump controller 30 as well as to the pressure limiter 34. At the control input 40 now the system pressure P2 is present and the pressure limiter 34 opens as soon as the pressure of the desired value 42 is exceeded. Since then the pressure decreases at the first input 36, the pump controller 30 is adjusted toward minimum delivery. This means that in the event of a failure of the motor computer 76, the system pressure P2 is defined by the desired value 42. Also in this variant, the second input 38 may be connected to the control input 40, as in the variants in FIGS. 3 and 6. This variant would then also be substantially loss-free.

FIG. 8 shows a further variant of the disclosure, wherein hereinafter only the differences compared to the variant according to FIG. 1 will be addressed. The pressure limiter 34 is formed by a hydraulically operated control valve 86 (a 4/2-way valve), the one controlled variable 42 of which is for example 5.5 bar. The other controlled variable is supplied by the system pressure P2 present at the input 88. In the position of the control valve 86 shown in FIG. 8, the second input 32 of the pump controller 30 is connected to the tank 14 and the first input 28 of the pump controller 30 is connected to the output 16 of the feed pump 10. As a result, the pump controller 30 is adjusted toward maximum delivery. If the system pressure P2 exceeds the controlled variable 42, the control valve 86 changes the position, applies the system pressure P2 at the second input 32 of the pump controller 30 and connects the first input 28 of the pump controller 30 to the tank 14. The pump controller 30 is adjusted toward minimum delivery, so that the system pressure P2 also decreases. If the system pressure P2 drops below the controlled variable 42, the control valve 86 assumes its starting position again. FIG. 9 shows this variant in one embodiment, to which the above-mentioned components are connected. Identical components are identified by the same reference numerals.

In the variant of the disclosure shown according to FIG. 10, in the original position of the control valve 86 the second input 32 of the pump controller 30 is connected to the tank 14 and the output 16 of the feed pump 10 is directly connected to the consumer 26. The pump controller 30 is adjusted toward maximum delivery as long as the feed pressure P1 is below the controlled variable 42. If the feed pressure P1 exceeds the controlled variable 42, the output 24 of the pressure-reducing element 20 is connected to the tank 14 and the output 16 of the feed pump 10 is connected to the second input 32 of the pump controller 30, so that the pump controller 30 is adjusted toward minimum delivery since at the first input 28 a pressure is present, which due to the regulator 48 is smaller than the feed pressure P1. FIG. 11 shows this variant in one exemplary embodiment.

In the variant of the disclosure shown according to FIG. 12, which corresponds substantially to FIG. 5, the pressure limiter 34 is configured as a 4/2-way valve 90. The first control input 40 is connected to the shut-off valve 78 and the second control input 74 is connected to the control valve 72 as well as to the shut-off valve 78. As soon as the feed pressure P1 and the system pressure P2 exceed the controlled variable 42, the directional control valve 90 switches and connects the first input 28 to the tank 14 so that the pump controller 30 is adjusted toward minimum delivery.

In the embodiment according to FIG. 13, the 4/2-way valve 90 connects the second input 32 of the pump controller 30 to the tank so that the pump controller 30 is initially adjusted toward maximum delivery. In addition, the output 24 is connected to the first input 28 of the pump controller 30 at the system pressure P2. As soon as the feed pressure P1 and the system pressure P2 exceed the controlled variable 42, the directional control valve 90 switches and connects the second input 32 of the pump controller 30 to the output 24 and the first input 28 of the pump controller 30 to the tank 14, so that the pump controller 30 is adjusted toward minimum delivery.

In the switch position shown according to FIG. 14, which corresponds to that according to FIG. 12, the control valve 72 and the shut-off valve 78 are switched. Since the second input 32 of the pump controller 30 is connected to the tank 14, the pump controller 30 is adjusted toward maximum delivery. At the consumer 26, the system pressure P2 is present.

In the switch position shown according to FIG. 15, which corresponds to that according to FIG. 13, the control valve 72 and the shut-off valve 78 are likewise switched. The second input 32 of the pump controller 30 is connected to the tank 14 and the first input 28 is connected to the output 24. The pump controller 30 is adjusted toward maximum delivery, and the system pressure P2 is present at the consumer 26. The advantage with the latter variant is that the adjusting chambers of the pump controller 30 on the clean oil side are supplied with the system pressure P2. As a result, failure due to contamination can be largely excluded.

FIG. 16 shows a variant of the disclosure according to FIG. 8, wherein the pressure limiter 34 is configured as a 4/2-way valve and is driven by electromagnetic force not only via the input 88 at which the system pressure P2 is present, but also in parallel by means of the motor computer 76. In the position shown according to FIG. 16, the first input 28 of the pump controller 30 is connected to the tank 14 and the second input 32 of the pump controller 30 is connected to the output 24. The pump controller 30 is adjusted toward minimum delivery. In the event of a failure of the motor computer 76, the 4/2-way valve 86 switches so that the second input 32 of the pump controller 30 is connected to the tank 14 and the first input 28 is connected to the output 24. The pump controller 30 is adjusted toward maximum delivery.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

The invention claimed is:

1. A variable delivery feed pump for hydraulic media, comprising an input and an output, at the output a feed pressure (P1) being present, a pressure-reducing element that is connected to the output, at an output of the pressure-reducing element the system pressure (P2) being present and the output of the pressure-reducing element being connected to a consumer, wherein the output of the variable delivery pump is connected to a first input of a pump controller, and a second input of the pump controller is connected to the output of the pressure-reducing element, and wherein the pump controller adjusts the feed pump toward maximum delivery if the system pressure (P2) is smaller than a minimum pressure or if the system pressure (P2) is smaller than the pressure present at the first input, and wherein parallel to the pump controller a pressure limiter is switched such that at a first input thereof the pressure present at the first input of the pump controller is present and that at a control input the system pressure (P2) is present, the pressure limiter opening if the system pressure (P2) is greater than a desired value.

2. The feed pump according to claim 1, characterized in that the pressure-reducing element is a filter.

3. The feed pump according to claim 1, characterized in that the minimum pressure is 1.5 bar to 3 bar, and is adjustable during controlled operation and standstill of the controller.

4. The feed pump according to claim 1, characterized in that the desired value is about 4 bar to about 8 bar, and is adjustable during controlled operation and standstill of the controller.

5. The feed pump according to claim 1, characterized in that a regulator is interconnected between the output of the feed pump and the first input of the pump controller.

6. The feed pump according to claim 1, characterized in that a pressure control valve is provided downstream of the output of the feed pump.

7. The feed pump according to claim 6, characterized in that at about 9 bar to about 15 bar, and at an adjustable pressure, the pressure control valve opens into a tank.

8. The feed pump according to claim 1, characterized in that the system pressure (P2) is present at a second input of the pressure limiter and the open pressure limiter connects the first input to the second input.

9. The feed pump according to claim 1, characterized in that the pressure limiter comprises a second control input.

10. The feed pump according to claim 9, characterized in that the two control inputs of the pressure limiter are hydraulically connected in series.

11. The feed pump according to claim 9, characterized in that the second control input of the pressure limiter provides pressure force transmission in addition to the first control input.

12. The feed pump according to claim 9, characterized in that a control valve is provided, which connects the output of the pressure-reducing element to the second control input of the pressure limiter.

13. The feed pump according to claim 12, characterized in that the output of the control valve is connected to the second input of the pressure limiter.

14. The feed pump according to claim 12, characterized in that the control valve is controlled by at least one of hydraulically and electromagnetically.

15. The feed pump according to claim 14, characterized in that the control valve is controlled via an engine controller of a motor vehicle.

16. The feed pump according to claim 12, characterized in that a shut-off valve is provided between the output of the control valve and the first control input of the pressure limiter.

17. The feed pump according to claim 16, characterized in that the shut-off valve comprises a control input at which the system pressure (P2) is present.

* * * * *